US005788233A

United States Patent [19]

Wolfe

[11] Patent Number: 5,788,233

[45] Date of Patent: Aug. 4, 1998

[54] CREATIVE BUILDING GAME

[76] Inventor: Terry Lee Wolfe, P.O. Box 159, Market St., Berrysburg, Pa. 17005

[21] Appl. No.: 903,209

[22] Filed: Jul. 21, 1997

[51] Int. Cl.[6] ..... A63F 9/00

[52] U.S. Cl. ..... 273/156; 446/125

[58] Field of Search ..... 273/153 R, 156, 273/157 R, 265; 473/417; 446/121, 122, 118, 124, 125

[56] References Cited

U.S. PATENT DOCUMENTS

| | | | |
|---|---|---|---|
| 1,216,840 | 2/1917 | Ramsey et al. | 446/124 |
| 2,542,252 | 2/1951 | Ickler | 273/156 |
| 2,565,823 | 8/1951 | Pool | 446/125 |
| 3,378,261 | 4/1968 | Schriber | 273/265 |
| 4,602,908 | 7/1986 | Kroeber | 446/124 |
| 4,854,587 | 8/1989 | Groves | 473/417 |
| 5,057,049 | 10/1991 | Kaczperski | 446/124 |

*Primary Examiner*—Steven B. Wong

[57] ABSTRACT

A new Creative building game for STIMULATING CREATIVITY IN CHILDREN. The inventive device includes a plurality of building blocks of different geometric shapes. Each of the building blocks have a plurality of protrusions disposed on outer surfaces thereof. The plurality of protrusions of each of the blocks are capable of engagement to each other for the construction of unique structures. A rule book is provided for defining participation. A plurality of L-shaped divider panels are provided to hide the creativity of the participants.

8 Claims, 5 Drawing Sheets

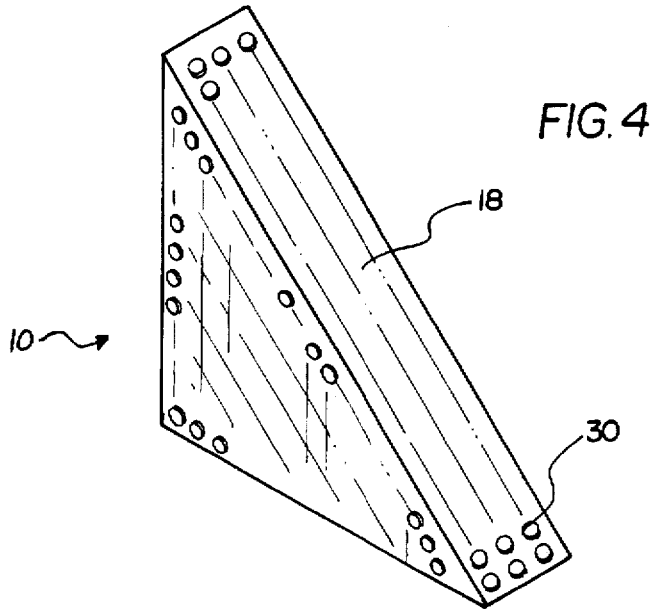
FIG. 4
FIG. 5
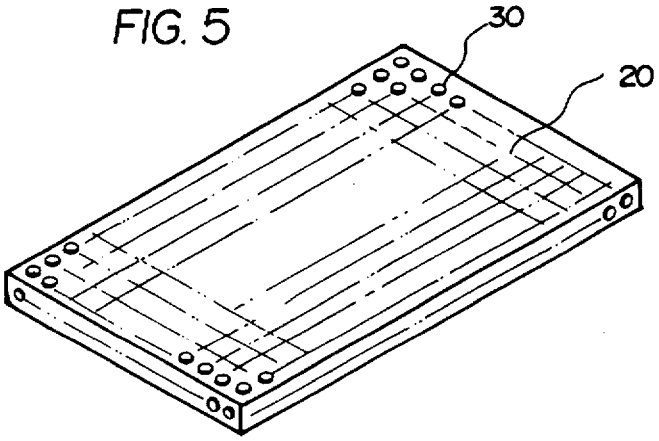
FIG. 6
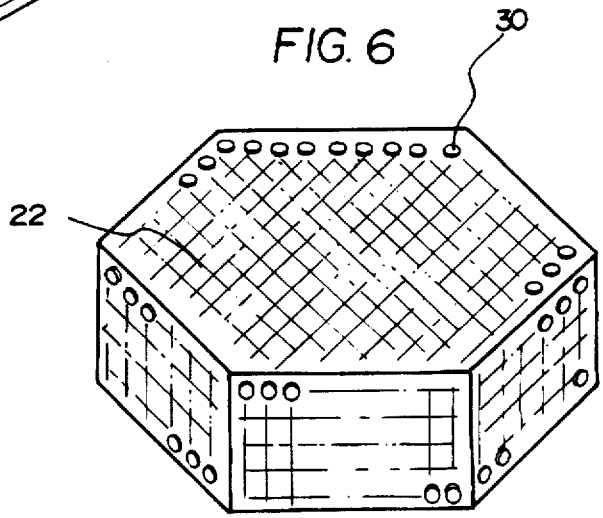

FIG. 7
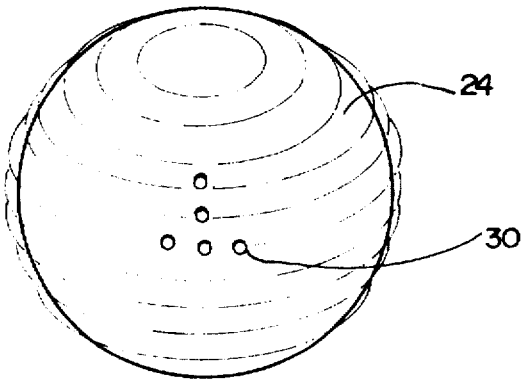
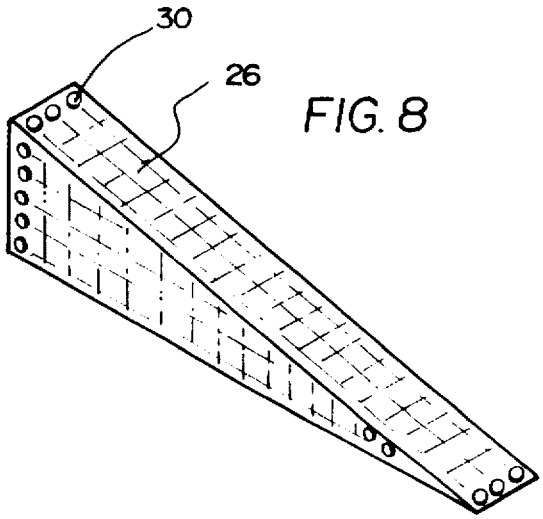
FIG. 8
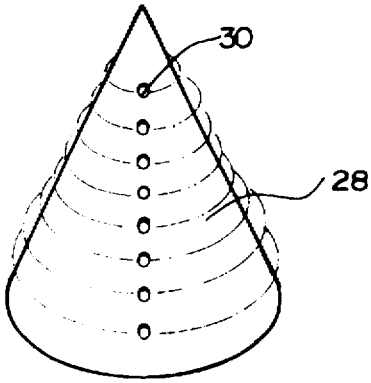
FIG. 9

FIG. 10
32
| PLAYER | POINTS | CREATION | ROUND |
|---|---|---|---|
| | | | |
| | | | |
| | | | |
| | | | |
| | | | |
| | | | |
| | | | |
| | | | |
| | | | |
| | | | |
| | | | |
| | | | |
| | | | |
| | | | |
| | | | |
FIG. 11
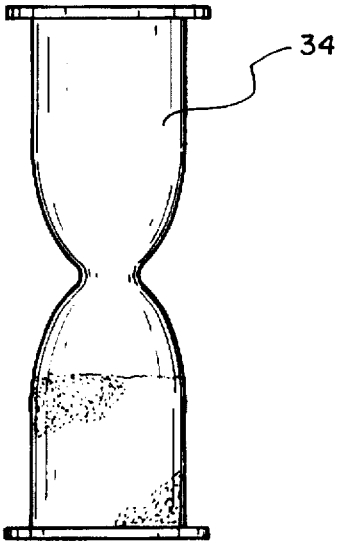
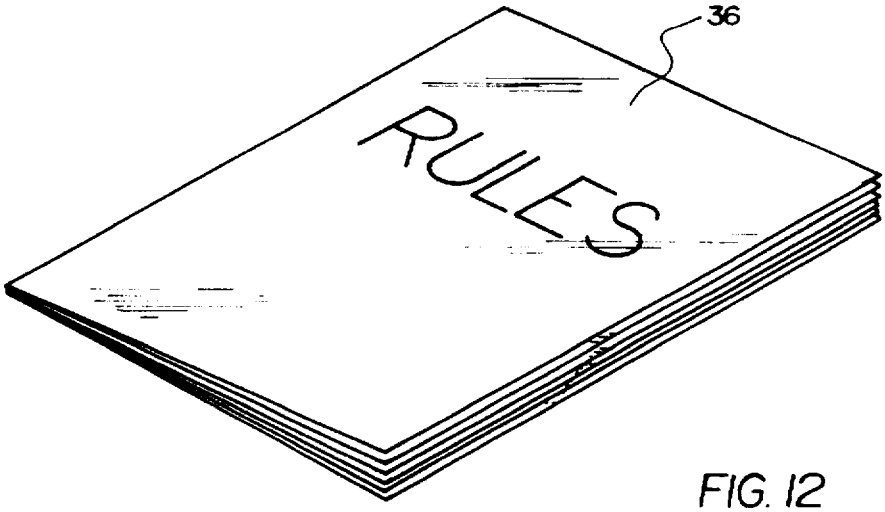
FIG. 12

CREATIVE BUILDING GAME

BACKGROUND OF THE INVENTION

1. Field of the Invention

The present invention relates to BUILDING BLOCK GAMES and more particularly pertains to a new Creative building game for STIMULATING CREATIVITY IN CHILDREN.

2. Description of the Prior Art

The use of BUILDING BLOCK GAMES is known in the prior art. More specifically, BUILDING BLOCK GAMES heretofore devised and utilized are known to consist basically of familiar, expected and obvious structural configurations, notwithstanding the myriad of designs encompassed by the crowded prior art which have been developed for the fulfillment of countless objectives and requirements.

Known prior art BUILDING BLOCK GAMES include U.S. Pat. No. 5,057,049 to Kaczperski; U.S. Pat. No. Des. 285,100 to Volpe; U.S. Pat. No. Des. 354,526 to Ryaa et al.; U.S. Pat. No. 4,602,908 to Kroeber; U.S. Pat. No. Des. 344,302 to Plagborg; and U.S. Pat. No. 4,740,189 to Bertrand.

While these devices fulfill their respective, particular objectives and requirements, the aforementioned patents do not disclose a new Creative building game. The inventive device includes a plurality of building blocks of different geometric shapes. Each of the building blocks have a plurality of protrusions disposed on outer surfaces thereof. The plurality of protrusions of each of the blocks are capable of engagement to each other for the construction of unique structures. A rule book is provided for defining participation. A plurality of L-shaped divider panels are provided to hide the creativity of the participants.

In these respects, the Creative building game according to the present invention substantially departs from the conventional concepts and designs of the prior art, and in so doing provides an apparatus primarily developed for the purpose of STIMULATING CREATIVITY IN CHILDREN.

SUMMARY OF THE INVENTION

In view of the foregoing disadvantages inherent in the known types of BUILDING BLOCK GAMES now present in the prior art, the present invention provides a new Creative building game construction wherein the same can be utilized for STIMULATING CREATIVITY IN CHILDREN.

The general purpose of the present invention, which will be described subsequently in greater detail, is to provide a new Creative building game apparatus and method which has many of the advantages of the BUILDING BLOCK GAMES mentioned heretofore and many novel features that result in a new Creative building game which is not anticipated, rendered obvious, suggested, or even implied by any of the prior art BUILDING BLOCK GAMES, either alone or in any combination thereof.

To attain this, the present invention generally comprises a plurality of building blocks of different geometric shapes. The geometric shapes include a cylinder, a cube, a disc, a triangle, a square, a hexagon, a sphere, a wedge and a cone. Each of the building blocks have a plurality of protrusions disposed on outer surfaces thereof. The plurality of protrusions of each of the blocks are capable of engagement to each other. A score card is provided. The score card is used for subjectively scoring creation of structures made by piecing together of the building blocks. A timer is provided. A rule book is provided that defines participation. A plurality of L-shaped divider panels are included. Each of the divider panels have a base member secured to a lower edge thereof. The base member have a weight disposed therein. A lower surface of the base member has a pad disposed thereon.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Creative building game apparatus and method which has many of the advantages of the BUILDING BLOCK GAMES mentioned heretofore and many novel features that result in a new Creative building game which is not anticipated, rendered obvious, suggested, or even implied by any of the prior art BUILDING BLOCK GAMES, either alone or in any combination thereof.

It is another object of the present invention to provide a new Creative building game which may be easily and efficiently manufactured and marketed.

It is a further object of the present invention to provide a new Creative building game which is of a durable and reliable construction.

An even further object of the present invention is to provide a new Creative building game which is susceptible of a low cost of manufacture with regard to both materials and labor, and which accordingly is then susceptible of low prices of sale to the consuming public, thereby making such Creative building game economically available to the buying public.

Still yet another object of the present invention is to provide a new Creative building game which provides in the apparatuses and methods of the prior art some of the advantages thereof, while simultaneously overcoming some of the disadvantages normally associated therewith.

Still another object of the present invention is to provide a new Creative building game for STIMULATING CREATIVITY IN CHILDREN.

Yet another object of the present invention is to provide a new Creative building game which includes a plurality of building blocks of different geometric shapes. Each of the building blocks have a plurality of protrusions disposed on outer surfaces thereof. The plurality of protrusions of each of the blocks are capable of engagement to each other for the construction of unique structures. A rule book is provided for defining participation. A plurality of L-shaped divider panels are provided to hide the creativity of the participants.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a perspective view of a triangle piece of the present invention.

FIG. 5 is a perspective view of a square piece of the present invention.

FIG. 6 is a perspective view of a hexagon piece of the present invention.

FIG. 7 is a perspective view of a sphere piece of the present invention.

FIG. 8 is a perspective view of a wedge piece of the present invention.

FIG. 9 is a perspective view of a cone piece of the present invention.

FIG. 10 is a view of a score card of the present invention.

FIG. 11 is a view of a sand timer of the present invention.

FIG. 12 is a perspective view of a rules book of the present invention.

DESCRIPTION OF THE PREFERRED EMBODIMENT

Figure 1:
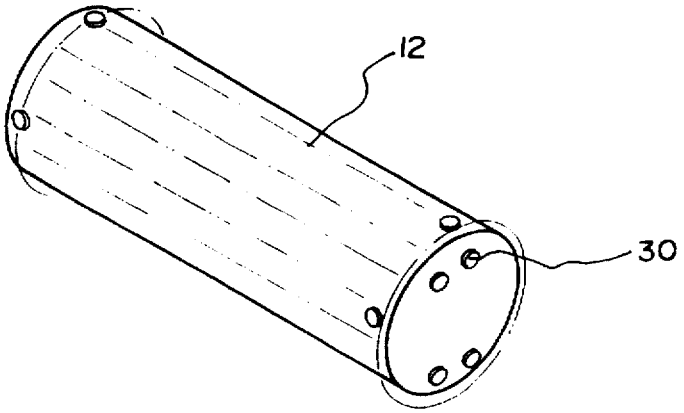
FIG. 1 is a perspective view of a cylindrical piece of a new Creative building game according to the present invention.
Figure 2:
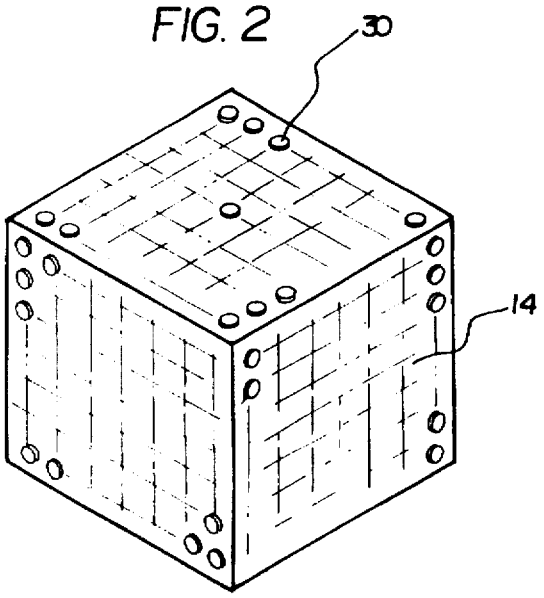
FIG. 2 is a perspective view of a cube piece of the present invention.
Figure 3:
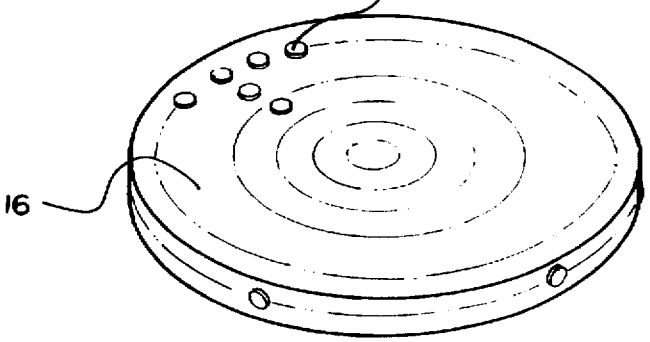
FIG. 3 is a perspective view of a disc piece of the present invention.
Figure 13:
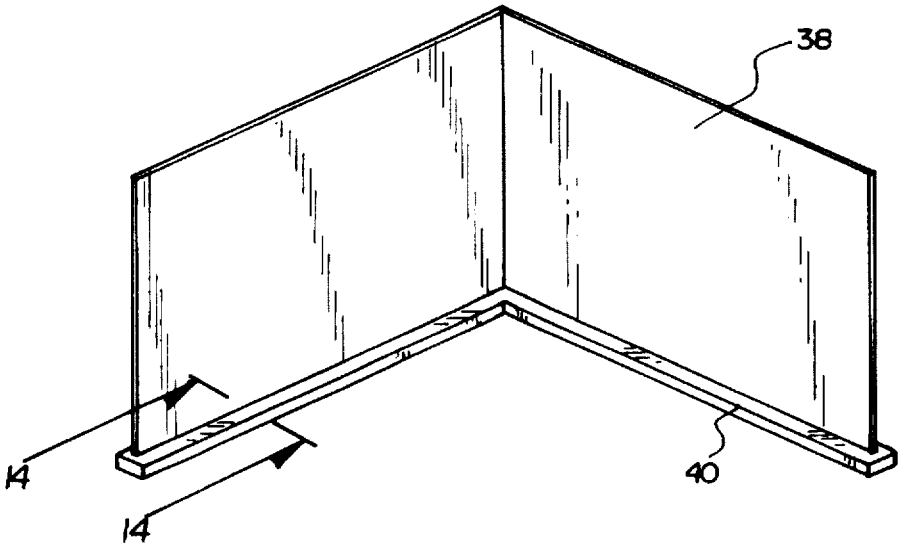
FIG. 13 is a perspective view of a divider of the present invention.
Figure 14:
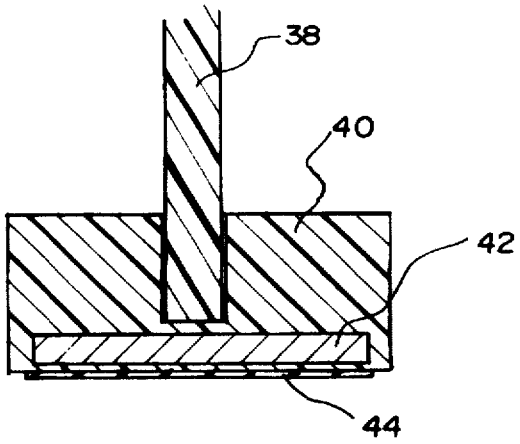
FIG. 14 is a cross-sectional view as taken along line 14—14 of FIG. 13.

With reference now to the drawings, and in particular to FIGS. 1 through 14 thereof, a new Creative building game embodying the principles and concepts of the present invention and generally designated by the reference numeral 10 will be described.

As best illustrated in FIGS. 1 through 14, the Creative building game 10 comprises a plurality of building blocks of different geometric shapes. The geometric shapes include a cylinder 12, a cube 14, a disc 16, a triangle 18, a square 20, a hexagon 22, a sphere 24, a wedge 26 and a cone 28. Each of the building blocks have a plurality of protrusions 30 disposed on outer surfaces thereof. The plurality of protrusions 30 of each of the blocks are capable of engagement to each other. Different sizes of each geometric shape are also provided.

A score card 32 is provided. Note FIG. 10. The score card 32 is used for subjectively scoring creation of structures made by piecing together of the building blocks. The score card 32 in the preferred embodiment provides a column for each players name, a column for points awarded, a column for identifying the creation and a column for indication of a round of play.

A timer 34 is provided. The timer 34 is the preferred embodiment is of the hour glass variety. Note FIG. 11. However, other means of timing could also be employed.

A rule book 36 is provided that defines participation. Note FIG. 12. The rule book 36 includes the following rules for play. Each player will roll a die or determine some way for a player to go first. Each player randomly selects building blocks, preferably from a bag or other holder. The timer 34 is set in motion to set a limit for the amount of time each player is given for creation. Once the time has expired, all of the players vote on the creation. If the creation is identifiable it will be accepted as a creation and the player is awarded points. A majority of votes is required for acceptance or rejection.

A plurality of L-shaped divider panels 38 are included. Note FIGS. 13 and 14. Each of the divider panels 38 have a base member 40 secured to a lower edge thereof. The base member 40 have a weight 42 disposed therein. A lower surface of the base member 40 has a pad 44 disposed thereon. The divider panels 38 allow each player to hide their building blocks while they are creating.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A creative building game comprising:

a plurality of building blocks, each of said building blocks having a generally geometric shape, each of the building blocks having a plurality of protrusions disposed on outer surfaces thereof, the plurality of protrusions of each of the building blocks being capable of engagement to each other;

a rule book defining parameters of participation, said parameters including awarding a pre-determined point value to a player for a creative assembly of said building blocks;

a plurality of L-shaped divider panels, said L-shaped divider panels being adapted for preventing a player from seeing the creative assembly of said building blocks of another player while the game is being played.

2. The creative building game as set forth in claim 1 wherein the geometric shapes of the building blocks include a cylinder, a cube, a disc, a triangle, a square, a hexagon, a sphere, a wedge and a cone.

3. The creative building game as set forth in claim 1 wherein each of the divider panels has a base member secured to a lower edge thereof, the base member having a weight disposed therein, a lower surface of the base having a pad disposed thereon.

4. The creative building game as set forth in claim 1 and further including a score card for subjectively scoring creation of structures made by piecing together of the building blocks.

5. The creative building game as set forth in claim 1 and further including a timer.

6. A creative building game comprising:

a plurality of generally geometrically shaped building blocks, each of the building blocks having a plurality of protrusions disposed on outer surfaces of the respective building block, the plurality of protrusions of each of the blocks being capable of engagement to each other;

a rule book defining parameters for participation, said parameters including awarding a pre-determined point value to a player for a creative assembly of said building blocks;

a plurality of L-shaped divider panels, said L-shaped divider panels being adapted for preventing a player from seeing the creative assembly of said building blocks of another player while the game is being played;

wherein the geometric shapes of the building blocks include a cylinder, a cube, a disc, a triangle, a square, a hexagon, a sphere, a wedge and a cone;

wherein each of the divider panels has a base member secured to a lower edge thereof, the base member having a weight disposed therein, a lower surface of the base having a pad disposed thereon;

a score card for subjectively scoring creation of structures made by piecing together of the building blocks; and a timer.

7. A method of playing a creative building game, the steps of the game comprising:

providing a plurality of generally geometrically shaped building blocks, each of the building blocks having a plurality of protrusions disposed on outer surfaces of the respective building block, the plurality of protrusions of each of the blocks being capable of engagement to each other;

selecting of an equal number of said building blocks by each player of the game;

providing a plurality of L-shaped divider panels with each of said L-shaped divider panels being positioned between two players for preventing any player from seeing a creative assembly of said building blocks of another player while the game is being played;

starting a timer, said timer being set to expire after a predetermined time whereby each player must stop assembling said building blocks;

beginning assembly of said selected building blocks by each player into an identifiable shape simultaneously to starting said timer;

stopping assembly by of said selected building blocks by each player upon expiration of said timer;

revealing each player's creative assembly of a number of said selected building blocks by removing said divider panels from between players;

scoring of each player's creative assembly of said building blocks; and determining a winner by comparing player scores.

8. The method of claim 7 wherein the step of scoring each player's creative assembly includes awarding one point for each of said selected building blocks used by each player such that each player's score equals the number of said selected building blocks used in the creative assembly of the respective player.

* * * * *